US006776190B2

(12) United States Patent
Schoepke et al.

(10) Patent No.: US 6,776,190 B2
(45) Date of Patent: Aug. 17, 2004

(54) VALVE LIFT SPACER AND VALVE USING SAME

(75) Inventors: Randy Schoepke, Lacon, IL (US); Richard Berg, Manville, IL (US)

(73) Assignee: Caterpillar Inc., Peoria, IL (US)

( * ) Notice: Subject to any disclaimer, the term of this patent is extended or adjusted under 35 U.S.C. 154(b) by 95 days.

(21) Appl. No.: 10/117,884

(22) Filed: Apr. 8, 2002

(65) Prior Publication Data

US 2003/0188789 A1 Oct. 9, 2003

(51) Int. Cl.[7] ..... F15B 13/044

(52) U.S. Cl. ..... 137/625.65; 137/625.27; 239/96

(58) Field of Search ..... 137/625.27, 625.65; 239/92, 96; 251/129.18

(56) References Cited

U.S. PATENT DOCUMENTS 827,170 A * 7/1906 Murphy ..... 137/625.69
3,826,282 A * 7/1974 Noe ..... 137/625.69
3,976,103 A * 8/1976 Ostic ..... 137/625.69
6,354,270 B1 * 3/2002 Shafer ..... 137/625.64
6,354,271 B1 3/2002 Satapathy
6,363,913 B1 4/2002 Milam et al.
2003/0056757 A1 * 3/2003 Tian et al. ..... 123/446

* cited by examiner

*Primary Examiner*—Gerald A. Michalsky
(74) *Attorney, Agent, or Firm*—Liell & McNeil

(57) ABSTRACT

This invention pertains generally to valve lift spacers that determine the travel distance of a valve member, such as movement between upper and lower seats. In the case of pressure switching valves, such as those used in the fuel injection industry, valve travel distance is often relatively small. Because of realistic machining tolerances, it is often difficult to mass produce valves that consistently exhibit comparable travel distances, especially when those distances are on the order of microns. The present invention addresses this issue by providing valve lift spacers with a variety of thicknesses in order to compensate for the inevitable variation that would otherwise be produced due to the various valve components having realistic geometrical tolerances. The valve lift spacer and a valve using the same finds a principal use in fast response pressure switching valves, such as those utilized in electro-hydraulic actuator portion of a fuel injector.

17 Claims, 4 Drawing Sheets

VALVE LIFT SPACER AND VALVE USING SAME

TECHNICAL FIELD

The present invention relates generally to valves with a predetermined travel distance, and more particularly to a valve lift spacer for adjusting the travel distance of a valve member.

BACKGROUND

In one class of valves, a valve member's travel distance is determined by a thickness of a valve lift spacer, through which the valve member moves. The valve lift spacer typically separates two valve body components, such as an upper seat component and a lower seat component in the case of a three way valve. In some instances, consistent valve performance can be sensitive to variations in valve travel distance. For instance, relatively small fast acting pressure switching valves in fuel injection applications sometimes require consistent travel distances from one valve to another in order to produce consistent performance from one fuel injector to another. If the travel distances vary too substantially from one valve to another, the response time of the same can exceed acceptable variances, causing unacceptable deviations in performance from one fuel injector to another. Another problem associated with valves relates to routing passages through the valve in an effective and efficient manner. Efficiency could relate to decreasing valve leakage, whereas effectiveness could relate to ensuring a particular flow characteristic through the valve.

The present invention is directed to this and other problems associated with valve lift spacers and valves using the same.

SUMMARY OF THE INVENTION

A valve lift spacer comprises a metallic plate with a side surface separating the top surface from a bottom surface. The top surface includes a planar portion oriented parallel to a planar portion of the bottom surface. A valve travel bore extends between the top surface and the bottom surface. At least one of a first valve passage and a second valve passage extends between the top surface and the bottom surface.

In another aspect, a collection of valve lift spacers includes a plurality of plates, each belonging to one of a plurality of thickness groups. Each of the plates has a circumferential side surface separating an at least partially planar top surface from an at least partially planer bottom surface. Each plate also includes a valve travel bore, a first valve passage and a second valve passage extending between the surface and the bottom surface.

In still another aspect, a valve includes a first seat component separated from a second seat component by a valve lift spacer. A valve member is moveable between contact with the first seat component and the second seat component. A first passage is closed to a third passage when the valve member is in contact with the first seat. A second passage is closed to the third passage when the valve member is in contact with the second seat. At least one of the first passage and the second passage includes a segment extending through the valve lift spacer.

In still another aspect, a method of constructing a valve includes a step of trapping a valve member between a first seat component and a second seat component. The first seat component is separated from the second seat component by a valve lift spacer. A portion of at least one of the first passage and the second passage is located through the valve lift spacer.

In still another aspect, of the present invention, a method of making a fluid passage in a metallic valve component with a predetermined flow characteristic includes a step of opening a passage between opposing surfaces of a metallic valve component at least in part by machining a hole through the component. The hole is enlarged at least in part by flowing an abrasive slurry through the hole. A flow characteristic of the passage is measured. The enlarging step is performed until the measured flow characteristic is about equal to a desired flow characteristic.

DETAILED DESCRIPTION

Figure 1:
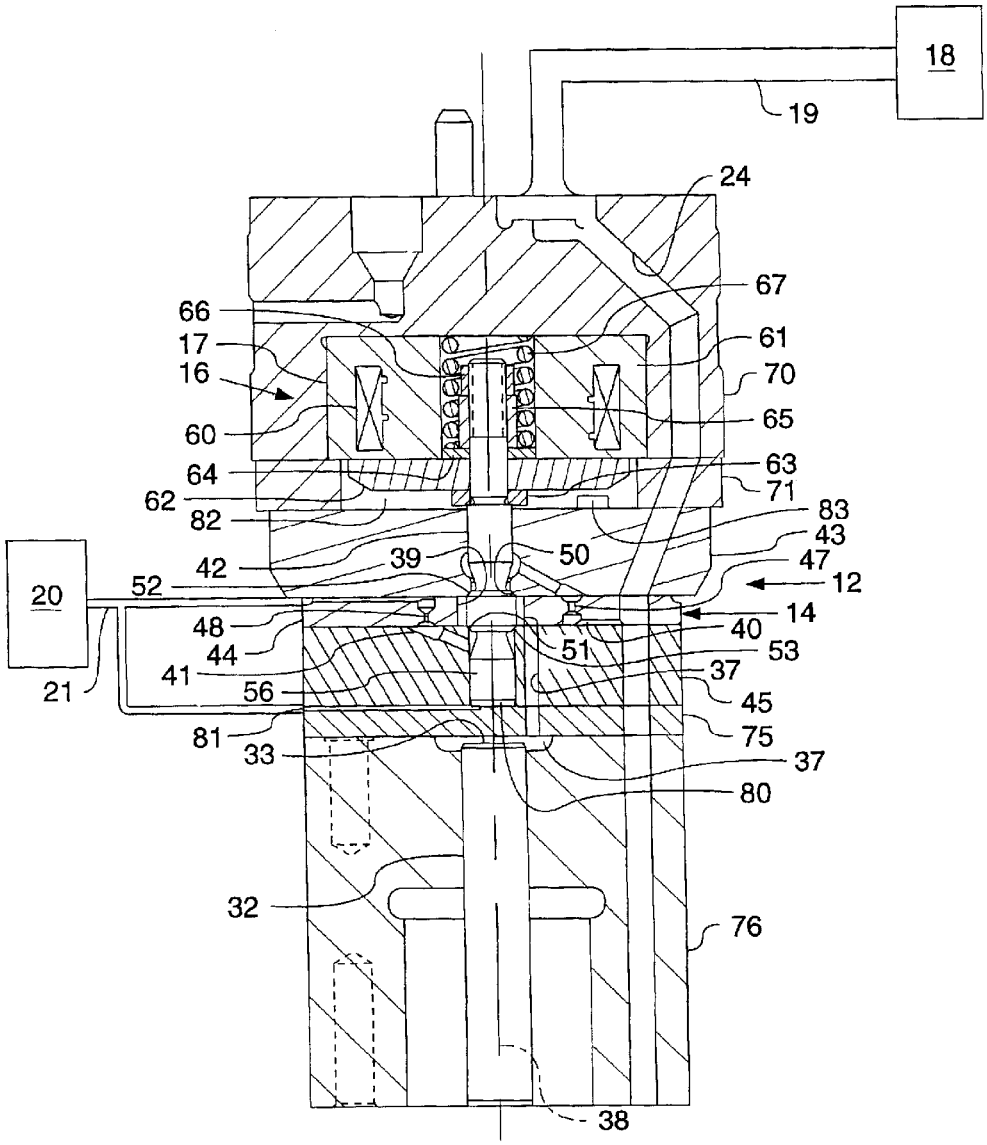
FIG. 1 is a sectioned side diagrammatic view of an electro-hydraulic actuator utilizing a valve lift spacer according to one aspect of the present invention.
Figure 4:
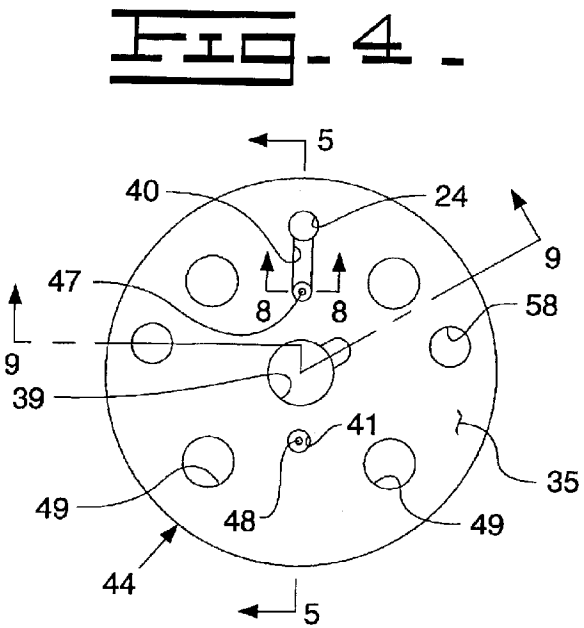
FIG. 4 is a bottom view of a valve lift spacer according to one aspect of the present invention.
Figure 2:
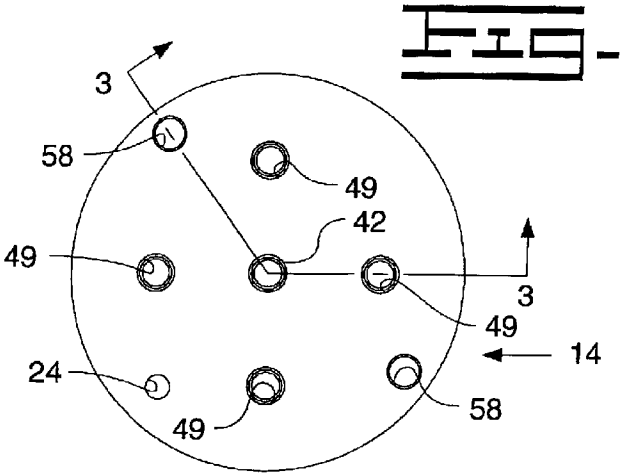
FIG. 2 is a top diagrammatic view of the valve portion of the electro-hydraulic actuator of FIG. 1.
Figure 3:
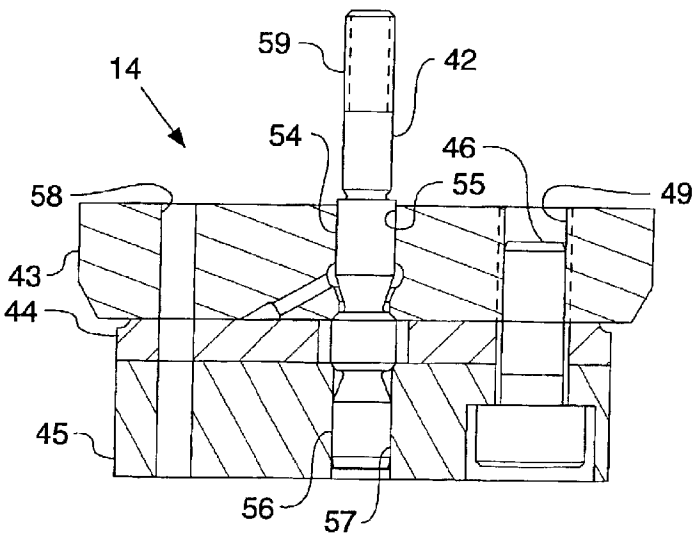
FIG. 3 is a sectioned side diagrammatic view of the valve of FIG. 2 as viewed along section line 3—3.

Referring to FIG. 1, electro-hydraulic actuator 12 is shown apart from a fuel injector (not shown) within which it could be used in relation to a direct control needle valve. In addition, FIGS. 2–3 show the three way valve assembly that makes up a portion of electro-hydraulic actuator 12 of FIG. 1. Three way control valve 14 is preferably positioned in close proximity to piston portion 32 so that the volume of needle control chamber 37 is made relatively small. Those skilled in the art will appreciate that pressure changes in needle control chamber 37 can be hastened by reducing its volume. This issue is addressed by actuator 12 in at least two ways. First, three way valve 14 is positioned in close proximity to the closing hydraulic surface 33 of piston portion 32. In addition, needle control chamber 37 is preferably designed to be defined at least in part by volume reducing surface features. Thus, those skilled in the art will recognize that some measurable amount of improved performance can be achieved by paying attention to what surface features, which define needle control chamber, can be changed in order to reduce the volume of needle control chamber 37 without otherwise undermining performance. In many instances, it will be desirable to make any flow areas associated with needle control chamber 37 less restrictive than the flow areas associated with high pressure passage 40, low pressure passage 41, or the flow areas across seats 50 and 51. When valve member 42 is in contact with lower seat 51, as shown, needle control chamber 37 is fluidly connected across high pressure seat 50 to supply passage 24 via high pressure passage 40. Supply passage 24 is fluidly connected to a source of high pressure liquid 18 via a high pressure supply line 19. When valve member 42 is lifted upward into contact with high pressure seat 50, needle control chamber 37 is fluidly connected to a low pressure area that surrounds actuator 12 across low pressure seat 51 via low pressure passage 41. Low pressure passage 41 is fluidly connected to a low pressure reservoir 20 via drain vent 21. As shown in FIG. 1. a length of low pressure passage 41 is defined by a top surface of the valve lift spacer 44 and upper seat component 43. Likewise. a length of high pressure passage 40 is defined by a bottom surface of valve lift spacer 44 and the lower seat component 45. Thus, valve member 42 can be thought of as being trapped between upper seat 50 and lower seat 51. In order to reduce the influence of hydraulic forces on opposite ends of valve member 42, a vent passage 83 vents armature cavity 82 to low pressure, and a vent passage 81 connects vented chamber 80 to low pressure.

Figure 6:
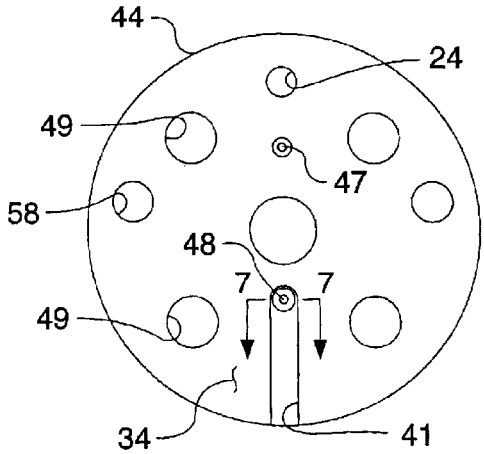
FIG. 6 is a top view of the valve lift spacer of FIG. 4.
Figure 7:
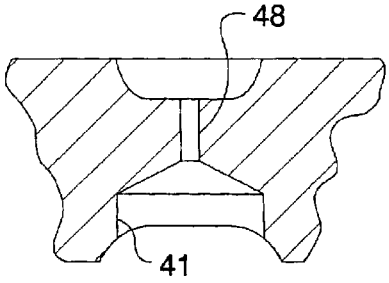
FIG. 7 is an enlarged section view of a passage through valve lift spacer as viewed along section lines 7—7 of FIG. 6.
Figure 8:
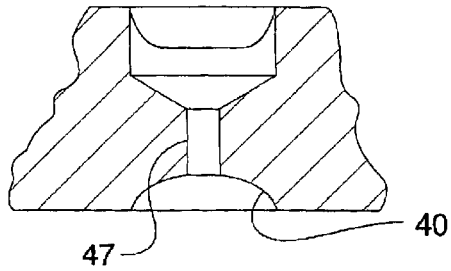
FIG. 8 is an enlarged sectioned side view of another passage through the valve lift spacer as viewed along section lines 8—8 of FIG. 4.
Figure 9:
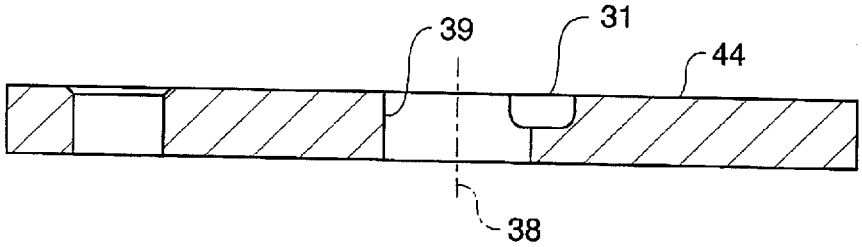
FIG. 9 is a sectioned side view of the valve lift spacer as viewed along section lines 9—9 of FIG. 4.

Valve member 42 is preferably operably coupled in a known manner to the moveable portion of an electrical actuator. In the illustrated embodiment, valve member 42 is attached to an armature 62 via a nut 63 that is threaded onto one end of valve member 42. In particular, an armature washer 63 rests upon an annular shoulder 58 (FIG. 6), upon which armature 62 is supported. Next, a nut washer 64 is placed in contact with the other side of armature 62 followed by a spacer 65, against which nut 66 bears. Armature 62 and hence valve member 42 are biased downward to close low pressure seat 51 by a suitable biaser, such as biasing spring 67. Those skilled in the art will appreciate that a hydraulic biaser could be an alternative to the mechanical biaser shown. In addition, while electrical actuator 16 has been shown as a solenoid, those skilled in the art will appreciate that any other suitable electrical actuator, such as a piezo or a voice coil could be substituted in its place. A stator assembly 17 is preferably positioned within a carrier assembly 70 such that there respective bottom surfaces lie flush in a common plane. By doing so, a solenoid spacer 71 having an appropriate thickness can be chosen to provide a desired air gap between armature 62 and stator 61. Thus, solenoid spacer 71 is preferably a categorized part that comes in variety of slightly different thicknesses that allow different valves to perform similarly by choosing an appropriate thickness to provide some uniformity in the armature air gap from one actuator to another.

Figure 5:
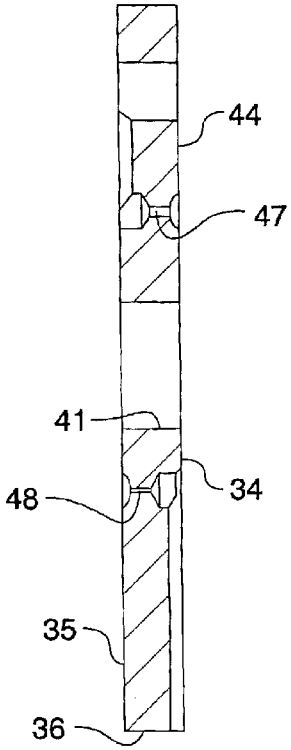
FIG. 5 is a sectioned side view of the valve lift spacer of FIG. 4 as viewed along section lines 5—5.

In order to aid in concentrically aligning upper seat 50 with lower seat 51 along common centerline 38, valve member 42 includes an upper guide portion 54 with a close diametrical clearance (i.e. a guide clearance) with an upper guide bore 55 located in upper seat component 43. In addition, valve member 42 also preferably includes a lower guide portion 56 having a relatively close diametrical clearance with a lower guide bore 57 located in lower seat component 45. Thus, these guide regions tend to aid in concentrically aligning upper and lower seats 50 and 51 during the assembly of three way valve 15 (FIG. 5) as well as substantially fluidly isolating needle control chamber 37 from vented chamber 80 and/or armature cavity 82, regardless of the position of valve member 42. Because it is difficult to be certain, before assembly, the depth into seats 50 and 51 that valve member 42 will penetrate before coming in contact in closing that particular seat, three way valve 15 preferably employs a valve lift spacer 44 that is also a category part, and is preferably categorized in a plurality of different thickness groups. Thus, the distance that valve member 42 travels between upper and lower seats 50 and 51 is adjustable by choosing an appropriate thickness for valve lift spacer 44.

In order to reduce the influence of fluid flow forces on the movement of valve member 42, high pressure passage 40 and low pressure passage 41 preferably include flow restrictions that are restrictive relative to a flow area across respective seats 50 and 51. While these flow restrictions could be located in upper seat component 43 and/or lower seat component 45, they are preferably located in valve lift spacer 44 as shown in FIG. 2. In particular, the flow characteristics through high pressure passage 40 can be relatively tightly controlled by including a cylindrical segment 47 having a predetermined length and flow area. Furthermore, cylindrical segment 47 is relatively restrictive to flow relative to that across upper seat 50. Those skilled in the art will appreciate that it is easier to control, and consistently machine, a flow characteristic via a cylindrical segment as opposed to attempting to consistently control a flow area between a stationary seat component and moveable valve member 42. Likewise, low pressure passage 41 preferably includes a cylindrical segment 48 that is located in valve lift spacer 44. In order to differentiate the rate at which pressure changes can occur in needle control chamber 37, cylindrical segment 48 preferably has a different flow area relative to cylindrical segment 47. This feature is present in the illustrated example as a strategy by which the opening rate of the direct control needle valve is slowed relative to the closure rate of the same. In other words, when piston 32 is moved fluid is displaced from needle control chamber 37 through the flow restriction defined by cylindrical segment 48. When direct control needle valve 11 is closed, high pressure fluid flows into needle control chamber 37 from high pressure passage 40 through the flow restriction defined by cylindrical segment 47. Since cylindrical segment 48 has a smaller flow area than cylindrical segment 47, in the illustrated embodiment, the movement rate of piston portion 32 is one direction can be made slower than its opposite movement rate. Although piston 32 could be located in a common body as lower seat component 45, it is preferably separated from the same by a relatively thin separator 75 and housed in its own piston guide body 76, as shown in FIGS. 1 and 2.

In order to accommodate for the possibility of a slight angular misalignment between the centerline of valve member 42 and the respective centerlines of upper and lower seats 50 and 51, valve member 42 preferably includes spherical valve surfaces 52 and 53. Those skilled in the art will appreciate that spherical valve seats 52 and 53 can contact and close valve seats 50 and 51 even in the event of some minor angular misalignment between valve member 42 and its respective seats. In order to insure that the respective passageways, such as supply passage 24, provide the proper fluid connection as shown in FIG. 1, the stationary components of three way valve 15 preferably include dowel bores 58 (FIGS. 2–3), which are present to prevent the valve from being misassembled. In order to hold three way valve 15 together, it preferably includes a plurality of fasteners 46 that are threadably received in fastener bores 49 located in upper seat component 43. Nevertheless, those skilled in the art will appreciate that numerous other strategies could be employed for clamping three way valve 15 together.

Referring to FIGS. 4–9, valve lift spacer 44 is shown in a variety of views that illustrate some of its more subtle features. In particular, valve lift spacer 44 preferably has a circumferential side surface 36 separating a mostly planar top surface 34 from a mostly planar bottom surface 35. Preferably, the planar portion of the top surface is oriented substantially parallel to the planar portion of bottom surface 35. As illustrated in FIGS. 1 and 3, valve lift spacer 44 includes a valve travel bore 39 within which valve member 42 moves when travelling between its upper and lower seats. Although not necessary in every application of the invention, this embodiment includes both an inlet passage 40 and an outlet passage 41 that extend between top surface 34 and bottom surface 35. Inlet passage 40 and outlet passage 41 include cylindrical segments 47 and 48, respectively, that exhibit predetermined flow characteristics. Preferably, both of these cylindrical segments are more restrictive to flow than flow across either of the respective high pressure seat 50 or low pressure seat 51, as discussed earlier.

Because cylindrical segments 47 and 48 are relatively small in diameter (less than a millimeter in the case of the illustrated embodiment), they are preferably machined in any suitable manner, such as via an EDM process. The holes are then enlarged by any suitable manner. For instance, the holes are preferably enlarged by flowing an abrasive slurry through the holes until each flow passage exhibits a predetermined flow characteristic, which is preferably correlated to some predetermined flow characteristic of a liquid used when the valve is in its intended use. For instance, in the illustrated embodiment, the flow characteristic of the abrasive slurry is correlated to a flow characteristic of fuel at some predetermined pressure differential, such as a pressure differential existing in a fuel injector between fuel at injection pressure levels and fuel at relatively low supply pressure levels. The abrasive slurry is preferably flowed through the passages 40 and 41 at a predetermined pressure differential. The progress of the enlargement process is preferably monitored by continuously monitoring the flow rate of the abrasive slurry through the respective passages. One could expect that the flow rate will continue to grow as the holes are enlarged, assuming that the pressure differential remains constant. When that flow rate rises to some predetermined flow rate that has been correlated to some flow characteristic of fuel, the passage is ready, and the individual valve lift spacer is advanced for further processing.

In order to protect against misassembly of valve 14, valve lift spacer preferably includes at least one dowel bore 58 that align with like bores in upper seat component 43 and lower seat component 45. A dowel in these bores insures that various passages in the various components 43–45, such as supply passage 24, align with one another when the valve is assembled as shown in FIG. 3. In addition, valve lift spacer 44 preferably includes at least one, in this case four, fastener bores 49 through which fasteners 46 extend through as shown in FIG. 3, in order to hold the valve in an assembled condition. In order for dowel bores 58 to function as locating surfaces, the bore walls preferably extend parallel to a centerline 38 of valve lift spacer 44. Of worthy mention with regard to FIGS. 1–9 is the inclusion on valve lift spacer 44 of at least one valve limiting surface 31. In this case, the portion of control volume 37 extending through lower seat component 45 terminates about half way through valve lift spacer 44 where it opens into valve travel bore 39. By making this portion of volume 37 penetrate only partially through valve lift spacer, its volume has been reduced relative to having that passage extend completely through valve lift spacer 44. By paying attention to surface details in order to reduce the overall volume of control volume 37, the response of electro hydraulic actuator 12 can be hastened since pressure changes in volume 37 can occur more quickly if its volume is small rather than being relatively large.

Figure 10:
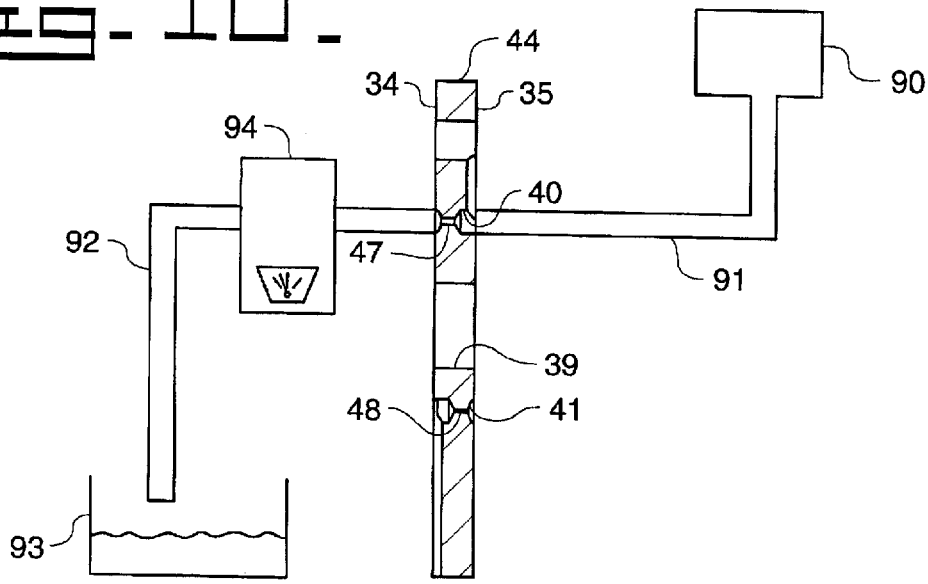
FIG. 10 is a schematic view of a hole enlargement apparatus according to another aspect of the present invention.

Referring now to FIG. 10, an apparatus for enlarging cylindrical segment 47 of outlet passage 40 in valve lift spacer 44 is illustrated. In practice, a source of high pressure abrasive slurry 90 is connected to inlet passage 40 adjacent top face 35. The abrasive slurry passes through cylindrical segment 47 and through bottom face 34, and onto low pressure reservoir 93 via drain line 92. A flow meter 94 is preferably located somewhere in supply line 91 and/or drain line 92. By continuously monitoring the flow rate of the abrasive slurry through cylindrical segment 47, while maintaining a predetermined pressure differential between high pressure source 90 and low pressure reservoir 93, one can monitor the progress of the hole enlargement process. In addition, by correlating the abrasive slurry flow rate at that predetermined pressure differential to some predetermined flow characteristic corresponding to an intended use of the valve, the valve lift spacer can be made to produce predictable performance.

Figure 11:
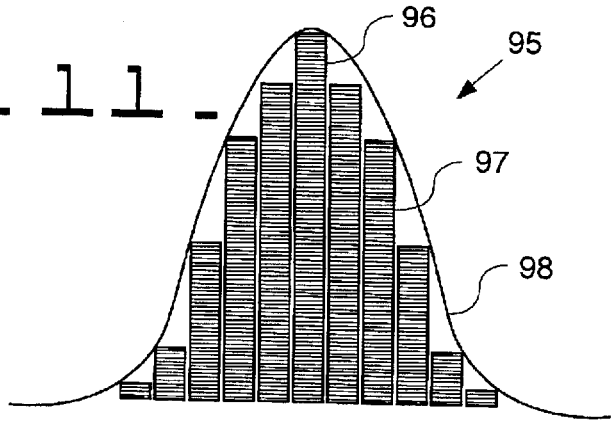
FIG. 11 is a graphical illustration of a collection of valve lift spacers according to still another aspect of the present invention.

Referring to FIG. 11, a collection of valve lift spacers 95 shows that each collection preferably includes a plurality of different thickness groups that correspond to a known probability distribution 98 about a nominal thickness. Probability distribution 98, in the present example, preferably corresponds to a distribution of valve lift spacer thicknesses that will produce valves with roughly equal travel distances given the natural variation that will occur due to typical part dimensional tolerances. Each collection 95 preferably includes a nominal thickness group 96 and a plurality of other thickness groups 97 that each include numbers corresponding to the probability distribution 98. In this way, when many valves of the type shown in FIGS. 2 and 3 are manufactured. One can manufacture valve lift spacers in a variety of thicknesses that will avoid over production of one or more thicknesses. In the illustrated example, the valve of FIGS. 1–3 preferably has a travel distance about equal to 30 microns plus or minus 5 microns. In order to accomplish this small and tight travel distance requirement, valve lift spacers are preferably divided into the thickness groups illustrated in FIG. 11. For the illustrated embodiment, each thickness group spans a range of thicknesses that is less than 10 microns. In the illustrated embodiment, each thickness group spans a range of about 6 microns. In other words, each valve lift spacer in a given group has a predetermined thickness, plus or minus about 3 microns.

INDUSTRIAL APPLICABILITY

The present invention finds potential application in any valve whose performance characteristics must be relatively tightly controlled, while at the same time providing a structure that permits mass production and relatively consistent performance from one valve to another. In addition, the present invention preferably finds particular application in the case of relatively high speed valves that are required to accommodate relatively low flow volumes, such as pressure control valves employed in fuel injection systems.

Shortly before the timing at which actuator 12 is activated via valve 14, electrical actuator 16 is preferably energized by supplying an excessive current to coil 60. Because the speed at which electrical actuator 16 operates is related to the current level supplied to coil 60, one preferably supplies an excessive current, which can be substantially higher than an amount of current necessary to cause the armature to move against the action of the spring bias. When sufficient magnetic flux builds, armature 62 and valve member 42 are pulled upwards until spherical valve surface 52 contacts upper or high pressure seat 50. When this occurs, needle control chamber 37 is fluidly connected to low pressure fuel reservoir 20 via low pressure passage 41. In order for piston portion 32 to move, fluid must be displaced from needle control chamber 37 toward low pressure reservoir 20. The rate at which piston 32 moves is slowed by restricting this flow through cylindrical segment 48. Shortly before the desired end of an actuation event, current to electrical actuator 16 is reduced or terminated to a level that allows spring 67 to push armature 62 and valve member 42 downward until spherical seat 53 comes in contact with low pressure seat 51. When this occurs, high pressure fluid originating in supply passage 24 flows through high pressure passage 40 past high pressure seat 50 and into needle control chamber 37. The rate at which pressure builds in needle control chamber 37 and hence the response time from when current is terminated until piston 32 moves toward another position can be influenced by appropriately sizing cylindrical segment 47.

In order to produce electro-hydraulic actuators 12 that behave consistently, the present invention preferably includes a structure for three way valve 15 that alleviates some of the problems that have plagued past valves. By including flow restrictions (cylindrical segments 47 and 48) away from valve seats 50 and 51, fluid flow forces that can interfere with movement of the valve member 42 are reduced since the pressure differentials often associated with valves are moved away from the valve seats. Furthermore, by locating these flow restrictions in the valve lift spacer, the flow restrictions can be more easily manufactured. This same strategy allows more consistency in performance among valves since their performance is desensitized from the flow areas across the respective seats of the valves. These flow areas will likely be different from one valve to another due at least in part to the fact that each component has geometrical tolerances that render them realistically manufacturable. Because the cylindrical segments formed in the valve lift spacers can be made with great consistency, the behavior of the respective valves can be made more consistent.

Another feature of the three way valve 14 of the present invention that can provide for more consistent performance includes the use of a valve lift spacer 44 as a category part. In other words, in order for consistency to be maintained, the valve travel distance from one valve to another should be made as consistent as possible. In the case of the present valve, this is accomplished by choosing a valve lift spacer for each individual valve with a thickness that results in a relatively uniform travel distance from one valve to another. In other words, each valve should have relatively uniform travel distances, but this is accomplished by employing valve lift spacers of a variety of thicknesses in each of the different valves. In the case of the present invention, the valve travel distance is preferably on the order of about 30 microns, or between 25 and 35 microns. In any event, the strategy of the present invention can be employed to reliably produce valves with consistent lifts less than about 50 microns. This is accomplished by grouping valve lift spacers in a plurality of different thickness groups. Preferably, each of these groups contain valve lift spacers of a specific predetermined thickness, plus or minus about three microns.

Another strategy employed by the present invention in order to improve response time includes defining the needle control chamber 37, which is referred to in the claims as the "third passage", at least in part with volume reducing features ordinarily, this will be accomplished by paying attention to machining the various components that make up needle control chamber 37 in order to reduce its volume. By reducing its volume, it can respond to pressure changes more quickly. For instance, in the present invention, this strategy is employed, for example, by making the vertical portion of needle control chamber 37 only extend a portion of the way into valve lift spacer 44. Thus, the top surface of this segment could be considered a volume reducing surface feature.

When manufacturing valve lift spacer 44, it preferably starts as a cylindrically shaped disk without the inclusion of cylindrical segments 47 and 48. These holes are then relatively roughly machined, such as by using an EDM process. This preferably takes the holes to a diameter that is some measurable amount smaller than its preferred end diameter. After the holes are "roughly" made through an appropriate process, the holes are preferably enlarged by flowing an abrasive slurry through the passage as illustrated in FIG. 10. This enlargement process is preferably continuously monitored with a flow meter 94. When the flow rate of the abrasive slurry reaches a predetermined magnitude, the enlargement process is ended and the hole should have its desired flow characteristics. This desired flow characteristic flow rate of the abrasive slurry is preferably correlated to a flow rate of a predetermined fluid at a predetermined pressure differential. In the illustrated example, this predetermined fluid could be fuel, and the pressure differential could correspond to the pressure differential between fuel at injection pressures and fuel at low pressure circulation pressures. After the respective cylindrical segments 47 and 48 are machined and enlarged to their predetermined flow characteristic profiles, the bottom and top faces 34 and 35 are preferably ground in a conventional manner, such as by using double disks, to a predetermined thickness. Preferably, the thickness of valve lift spacers are machined to correspond to the thickness groups illustrated in FIG. 11. When the valve is manufactured, past experience will have shown that a nominal lift spacer from the nominal thickness group 96 of FIG. 11 has the highest probability of producing a valve with a predetermined travel distance. Thus, each valve is preferably first assembled using a nominal thickness valve lift spacer. Next, the travel distance of the valve is measured. If the measured travel distance deviates from the desired predetermined travel distance by more than a predetermined amount (about 5 microns in the illustrated embodiment) then a different valve lift spacer from one of the other thickness groups is chosen. In other words, a different valve lift spacer having a thickness that, when substituted for the nominal valve lift spacer, will give the valve the desired predetermined travel distance. This process is accomplished by first determining a valve spacer thickness that would provide the valve with a travel distance that is about equal to a desired travel distance. Next, a thickness group is identified that corresponds to the valve spacer thicknesses associated with the desired travel distance. Next, a valve lift spacer from the identified thickness group is retrieved and substituted for the nominal valve lift spacer. Next, the travel distance is preferably again measured to confirm that the valve now has a travel distance that corresponds to the desired travel distance. When this is confirmed, the fasteners 46 are preferably tightened to some predetermined torque to complete the assembly of valve 14 illustrated in FIGS. 2 and 3.

Those skilled in the art will appreciate the other aspects, objects and advantages of this invention can be obtained from a study of the drawings, the disclosure and the appended claims.

What is claimed is:

1. A valve comprising:

a first seat component separated from a second seat component by a valve lift spacer;

a valve member movable between contact with a first seat of said first seat component and a second seat of said second seat component;

a first passage being closed to a third passage when said valve member is in contact with said first seat;

a second passage being closed to said third passage when said valve member is in contact with said second seat; and each of said first passage and said second passage including a segment extending through said valve lift spacer.

2. The valve of claim 1 wherein said valve member is movable a predetermined travel distance between said first seat and said second seat;

said predetermined travel distance being determined at least in part by a thickness of said valve lift spacer.

3. The valve of claim 1 wherein at least one of said first passage and said second passage exhibits a predetermined flow characteristic.

4. The valve of claim 3 wherein said predetermined flow characteristic includes a predetermined flow rate for a predetermined fluid at a predetermined pressure differential.

5. The valve of claim 3 wherein said first passage has a first predetermined flow characteristic; and said second passage has a second predetermined flow characteristic.

6. The valve of claim 1 wherein said segment is restrictive relative to a flow area across said first seat and said second seat.

7. The valve of claim 6 wherein said first passage and said second passage include a first cylindrical segment and a second cylindrical segment, respectively;

said first cylindrical segment being restrictive relative to a flow area past said first seat; and said second cylindrical segment being restrictive to a flow area past said second seat.

8. The valve of claim 7 wherein said first cylindrical segment has a different diameter than said second cylindrical segment.

9. The valve of claim 7 wherein a length of at least one of said first passage and said second passage is partially defined by one of a top surface and a bottom surface of said valve lift spacer.

10. The valve of claim 7 wherein a length of said first passage is defined by a top surface of said first seat component; and a length of said first passage is defined by a bottom surface of said second seat component.

11. The valve of claim 1 including an electrical actuator operably coupled to said valve member.

12. The valve of claim 11 wherein a length of said first passage is defined by a top surface of said first seat component; and a length of said first passage is defined by a bottom surface of said second seat component.

13. The valve of claim 1 wherein said first passage and said second passage include segments extending between a top surface and a bottom surface of the valve lift spacer.

14. The valve of claim 1 wherein a length of at least one of said first passage and said second passage is partially defined by one of a top surface and a bottom surface of said valve lift spacer.

15. A method of constructing a three way valve, comprising the steps of:

trapping a valve member to move between a first seat component and a second seat component to selectively close a first passage and a second passage to a third passage;

separating the first seat component from the second seat component by a valve lift spacer;

locating a portion of said first passage and said second passage through said valve lift spacer.

16. The method of claim 15 wherein said locating step includes a step of locating a portion of said first passage to extend between a top surface and a bottom surface of the valve lift spacer, and locating a portion of said second passage to extend between a top surface and a bottom surface of the valve lift spacer; and positioning a flow restriction in at least one of the portion of the second passage and the portion of the first passage, wherein the flow restriction is relative to a flow area between the valve member and a valve seat.

17. The method of claim 16 including a step of forming the flow restriction to have a predetermined flow characteristic for a predetermined fluid at a predetermined pressure.

* * * * *